US007469107B2

(12) United States Patent
Adkins et al.

(10) Patent No.: US 7,469,107 B2
(45) Date of Patent: Dec. 23, 2008

(54) METHOD FOR PROVIDING IMAGING SUBSTANCE FOR USE IN AN IMAGING DEVICE VIA A VIRTUAL REPLENISHMENT

(75) Inventors: Christopher A Adkins, Lexington, KY (US); Douglas L. Robertson, Lexington, KY (US); David C. Stevenson, Lexington, KY (US); Barry B. Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 993 days.

(21) Appl. No.: 10/625,383

(22) Filed: Jul. 23, 2003

(65) Prior Publication Data

US 2005/0019045 A1 Jan. 27, 2005

(51) Int. Cl.
*G03G 21/18* (2006.01)
*G07F 17/00* (2006.01)
*G07F 17/16* (2006.01)

(52) U.S. Cl. ..... 399/12; 399/79; 347/7

(58) Field of Classification Search ..... 705/22, 705/26, 28; 704/40; 399/12, 79; 347/7
See application file for complete search history.

(56) References Cited

U.S. PATENT DOCUMENTS 4,967,207 A * 10/1990 Ruder ..... 347/7
5,148,534 A 9/1992 Comerford
5,530,749 A 6/1996 Easter et al.
5,530,753 A 6/1996 Easter et al.
5,594,535 A * 1/1997 Beaufort et al. ..... 399/262
5,831,649 A 11/1998 Watrobski et al.
6,023,593 A * 2/2000 Tomidokoro ..... 399/8
6,099,101 A 8/2000 Maurelli et al.
6,164,758 A 12/2000 Kretschmer
6,164,760 A * 12/2000 Mizoguchi et al. ..... 347/55
6,170,937 B1 * 1/2001 Childers et al. ..... 347/85
6,212,505 B1 4/2001 Herbert
6,285,835 B1 * 9/2001 Guillemin et al. ..... 399/8
6,374,354 B1 4/2002 Walmsley et al.
6,406,120 B2 6/2002 Pauschinger
6,418,283 B1 7/2002 Wegman et al.
6,494,562 B1 * 12/2002 Walker et al. ..... 347/32
6,676,240 B2 * 1/2004 Walker ..... 347/19
6,771,385 B1 * 8/2004 Iizuka et al. ..... 358/1.15
6,792,216 B2 * 9/2004 Wachter et al. ..... 399/8
6,798,997 B1 * 9/2004 Hayward et al. ..... 399/12
6,895,192 B2 * 5/2005 Katoh et al. ..... 399/27
2001/0020961 A1 9/2001 Pauschinger (Continued)

*Primary Examiner*—Evens J Augustin
(74) *Attorney, Agent, or Firm*—Taylor & Aust, PC

(57) ABSTRACT

A method for providing a virtual replenishing of a supply item with an imaging substance includes the steps communicating to a database a first serial number associated with a first supply item; comparing the first serial number with a plurality of serial numbers stored in the database; receiving from the database one of a first data indicating non-correspondence between the first serial number with one of the plurality of serial numbers and a second data indicating correspondence between the first serial number with one of the plurality of serial numbers, wherein the second data includes a verification key; and if the verification key corresponds to the first key stored in the memory associated with the first supply item, then performing the step of allocating at least a portion of a surplus amount of the imaging substance contained in the first supply item for use.

90 Claims, 5 Drawing Sheets

U.S. PATENT DOCUMENTS

2002/0012541 A1* 1/2002 Takemoto et al.
2002/0042747 A1* 4/2002 Istvan ..... 705/26
2002/0071683 A1 6/2002 Guy et al.
2002/0077979 A1* 6/2002 Nagata ..... 705/40
2003/0086571 A1* 5/2003 Audebert et al. ..... 380/277
2004/0012645 A1* 1/2004 Kinalski et al. ..... 347/7
2004/0263542 A1* 12/2004 Eade ..... 347/1

* cited by examiner

METHOD FOR PROVIDING IMAGING SUBSTANCE FOR USE IN AN IMAGING DEVICE VIA A VIRTUAL REPLENISHMENT

BACKGROUND OF THE INVENTION

1. Field of the Invention

The present invention relates to a system for facilitating imaging, and, more particularly, to a method for providing imaging substance for use in an imaging device via a virtual replenishment of a supply of imaging substance.

2. Description of the Related Art

An imaging device typically has associated therewith a supply item, such as for example, an ink supply tank, an ink jet cartridge, a toner tank, or electrophotographic process (EP) cartridge, that stores a supply of an imaging substance, such as for example ink or toner, that is consumed during an imaging process. Examples of such an imaging device include an ink jet printer and/or copier, or an electrophotographic printer and/or copier. During imaging with the imaging device, the amount of the imaging substance is depleted. Thus, eventually, once the imaging substance supply of the supply item is exhausted, the supply item typically is either discarded or is refilled. In either event, the consumer must provide a new supply of imaging substance in order to continue imaging. Typically, the new supply of imaging substance is acquired by the purchase of additional imaging substance, or the purchase of an entirely new supply item. In either case, the purchasing process can inconvenience the consumer due to inherent delays in the purchasing process. For example, even when a vendor has the item, i.e., imaging substance or supply item, in stock, the consumer either must go to the vendor to obtain the desired item, or await the delivery of the desired item. Also, proper refill or disposal of a spent supply item can be an inconvenience to a consumer.

What is needed in the art is a method for providing imaging substance for use in an imaging device via a virtual replenishment of the supply of imaging substance.

SUMMARY OF THE INVENTION

The present invention is directed to a method for providing imaging substance for use in an imaging device via a virtual replenishment of a supply of imaging substance.

In one form thereof, the invention relates to a method for providing a virtual replenishing of a supply item with an imaging substance. The method includes the steps of providing a first supply item containing an actual supply of the imaging substance, the actual supply including a licensed amount of the imaging substance and a surplus amount of the imaging substance; communicating to a database a first serial number associated with the first supply item; comparing the first serial number with a plurality of serial numbers stored in the database; receiving from the database one of a first data indicating non-correspondence between the first serial number with one of the plurality of serial numbers and a second data indicating correspondence between the first serial number with one of the plurality of serial numbers, wherein the second data includes a verification key; and comparing the verification key received from the database with a first key stored in a memory associated with the first supply item, wherein if the verification key received from the database corresponds to the first key stored in the memory associated with the first supply item, then performing the step of allocating at least a portion of the surplus amount of the imaging substance contained in the first supply item for use.

In another form thereof, the invention relates to a method for providing a virtual replenishing of a supply item with an imaging substance. The method includes the steps of providing a first supply item containing an actual supply of the imaging substance, the actual supply including a licensed amount of the imaging substance and a surplus amount of the imaging substance; communicating to a mechanism a first serial number associated with the first supply item; generating a verification key based on the first serial number; comparing the verification key received from the mechanism with a first key stored in a memory associated with the first supply item, wherein if the verification key received from the mechanism corresponds to the first key stored in the memory associated with the first supply item, then performing the step of allocating at least a portion of the surplus amount of the imaging substance contained in the first supply item for use.

In another form thereof, the invention relates to a method for providing imaging substance for use in an imaging device. The method includes the steps of providing a first supply item containing an actual supply of the imaging substance, the actual supply including a licensed amount of the imaging substance and a surplus amount of the imaging substance; associating a memory with the first supply item; providing a database located remote from the memory for storing a plurality of serial numbers and a plurality of keys for a plurality of supply items; generating a first serial number for the first supply item; generating a first key associated with the first serial number; storing at least the first key in the memory associated with the first supply item; storing the first serial number in the database; storing the first key in the database as a verification key; installing the first supply item in the imaging device for use in imaging; and providing a virtual replenishing of the supply item with the imaging substance by the steps of communicating to the database the first serial number; comparing the first serial number with the plurality of serial numbers stored in the database; receiving from the database one of a first data indicating non-correspondence between the first serial number with one of the plurality of serial numbers and a second data indicating correspondence between the first serial number with one of the plurality of serial numbers, wherein the second data includes the verification key; and comparing the verification key received from the database with the first key stored in the memory of the first supply item, wherein if the verification key received from the database corresponds to the first key stored in the memory of the first supply item, then performing the step of allocating at least a portion of the surplus amount of the imaging substance contained in the first supply item for use.

In another form thereof, the invention relates to a method for providing imaging substance for use in an imaging device, including the steps of providing a first supply item containing an actual supply of the imaging substance, the actual supply including a licensed amount of the imaging substance and a surplus amount of the imaging substance; associating a memory with the first supply item; providing a mechanism located remote from the memory for associating a plurality of serial numbers with a respective plurality of keys for a plurality of supply items; generating a first serial number for the first supply item; generating a first key based on the first serial number; storing at least the first key in the memory associated with the first supply item; installing the first supply item in the imaging device for use in imaging; and providing a virtual replenishing of the supply item with the imaging substance by the steps of communicating to the mechanism the first serial number; generating a verification key based on the first serial number; comparing the verification key received from the mechanism with the first key stored in the memory of the first supply item, wherein if the verification key received from the mechanism corresponds to the first key stored in the memory of the first supply item, then performing the step of allocating at least a portion of the surplus amount of the imaging substance contained in the first supply item for use.

An advantage of the present invention is that a consumer can replenish, i.e., renew, an available supply of imaging substance without leaving their home or place of business.

Another advantage of the present invention is that the replenishment of the usable imaging substance in the supply item can be performed in a secure manner.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
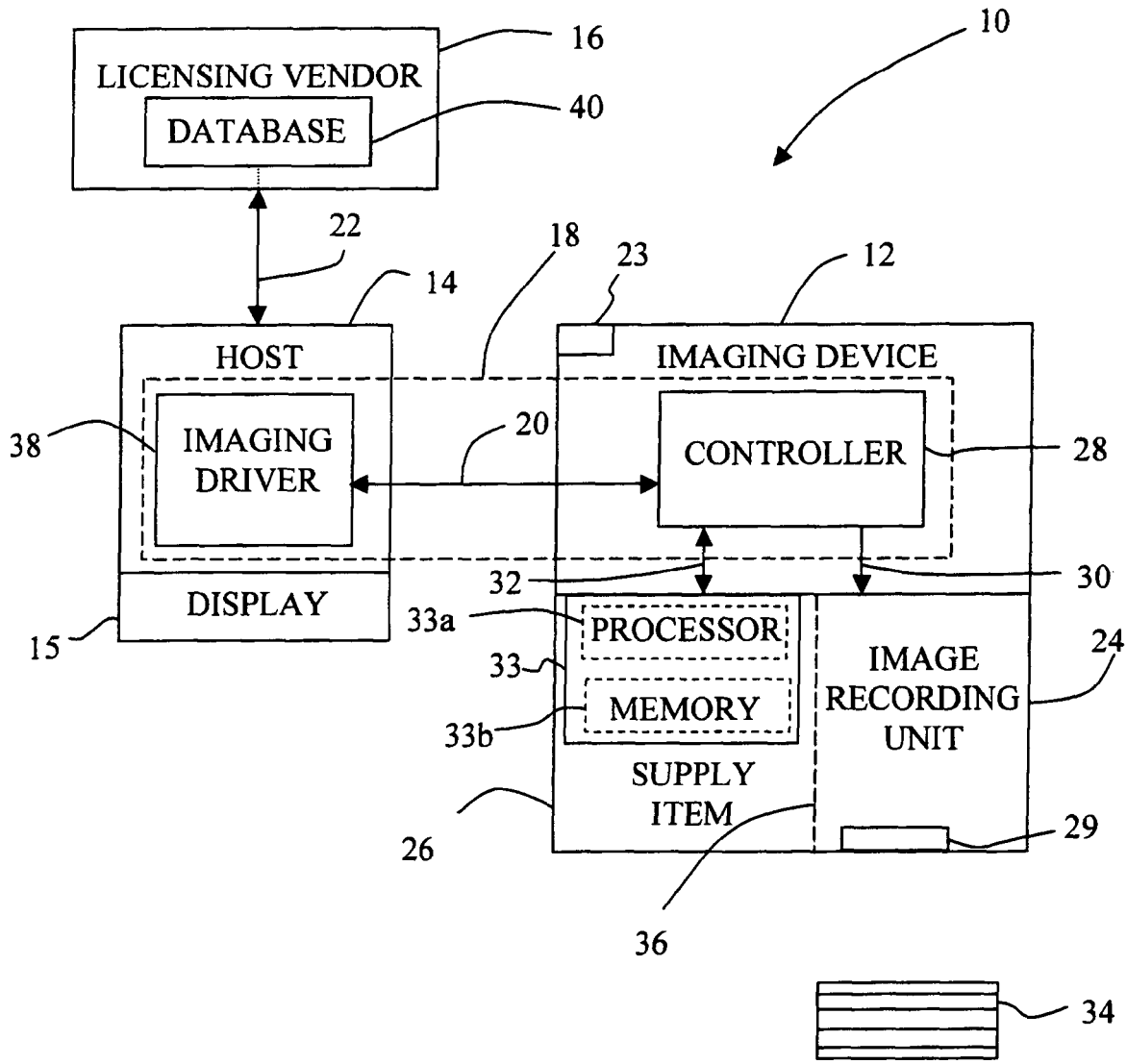
FIG. 1 is a diagrammatic depiction of a system for implementing a method of the present invention.

Referring now to the drawings, and particularly to FIG. 1, there is shown a diagrammatic depiction of a system 10 for implementing the method of the present invention. System 10 includes an imaging device 12, a host 14, a licensing vendor 16 and a license monitoring mechanism 18. Imaging device 12 communicates with host 14 via a communications link 20. Licensing vendor 16 communicates with host 14 via a communications link 22.

Imaging device 12 includes a user interface 23, an image recording unit 24, an supply item 26, and a controller 28 which may be in the form of an Application Specific Integrated Circuit (ASIC). Controller 28 communicates with image recording unit 24 via a communications link 30. Controller 28 communicates with supply item 26 via a communications link 32. Imaging device 12 can be, for example, an ink jet printer and/or copier, or an electrophotographic printer and/or copier, or a multi-function device.

In the context of the examples for imaging device 12 given above, image recording unit 24 can be, for example, an ink jet printhead unit or an electrophotographic printing unit, and includes an imaging head 29 used for forming an image on a substrate 34, such as a sheet of print media or a photoconductive member. For convenience, each type of substrate 34 will be referred to by the element number 34, for example, print media 34. Supply item 26 can be, for example, an ink supply tank, an ink jet cartridge, a toner tank, or an electrophotographic process (EP) cartridge, each of which containing a supply of an imaging substance, such as for example ink or toner, that is consumed during an imaging process. Imaging device 12 uses the imaging substance contained in supply item 26 to form an image on print media 34. Print media 34 can be, for example, sheets of paper, fabric or transparencies.

Those skilled in the art will recognize that image recording unit 24 and supply item 26 may be formed as individual discrete units, or may be combined in an integral unit, these options being depicted by dashed line 36. One example of such an integral unit is a printhead cartridge.

In one embodiment, supply item 26 has mounted thereto a memory module 33 for storing information relating to supply item 26, such as for example, a supply item serial number, a key, a value representing an initial amount of the imaging substance contained in supply item 26, a value representing a licensed amount of the imaging substance contained in supply item 26, a value representing an amount of usage of supply item 26, and a value representing a usage license.

Alternatively, supply item 26 may represent a permanently installed supply of imaging substance for imaging device 12. In such an embodiment, memory module 33 may reside in imaging device 12, such as for example, in controller 28.

In one configuration of memory module 33, for example, memory module 33 may include a processor 33*a* and a memory 33*b* having a plurality of memory locations. The processor 33*a* may be used for simple data processing, such as performing comparisons. Of the plurality of memory locations of memory 33*b*, thirty-two or more bits may be reserved for the supply item serial number, which for example is set by the manufacturer. Eight or more bits may be reserved for a key, which for example is set by the manufacturer. Eight or more bits may represent the fill level, i.e., the initial amount of the imaging substance contained in supply item 26. Eight or more bits may be used as a usage gauge to maintain a record of usage of supply item 26. And, five or more bits may be used to identify a usage license, and can include an identification that is randomly selected and includes an indication of the licensed amount of usage.

By attaching memory module 33 to supply item 26, in essence, a usage license, serial number, and key associated with supply item 26 can travel with supply item 26 from one imaging device to another. The licensed amount of usage may be represented in a variety of forms, such as for example, by the amount of imaging substance consumed from supply item 26, the number of imaging dots formed on print media 34, the percent of image coverage on the printed sheets of media 34, the number of printed sheets of supply item 26, the number of printed sheets of supply item 26 exceeding a predetermined coverage amount, or simply the number of imaging operations performed by imaging device 12. An alternative approach would be to base the usage license on a fixed time duration.

In practicing the present invention, preferably, the initial, i.e., actual, supply amount (fill level) of imaging substance contained in supply item 26 is greater than the licensed amount of the imaging substance. For example, the actual supply amount may include both a licensed amount of the imaging substance and a surplus amount of the imaging substance, with the surplus amount being used to accommodate license renewals or new licenses. For example, in one implementation of the invention, the initial supply amount of the imaging substance contained in supply item 26 can be, for example, at least two times greater than the licensed amount. It is important to note, however, that while the initial amount of imaging substance supplied with imaging device 12 and/or supply item 26 is more than sufficient to accommodate one or more license renewals, or new licenses, the consumer has been required to pay only for the licensed amount of imaging substance at the time of the original purchase.

Host 14 may be, for example, a personal computer including a display device 15, an input device (e.g., keyboard), a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 38 for imaging device 12. Imaging driver 38 is in communication with controller 28 of imaging device 12 via communications link 20. Imaging driver 38 serves to facilitate communications between imaging device 12 and licensing vendor 16. In addition, imaging driver 38 serves in the traditional roll of providing formatted print data to imaging device 12.

Licensing vendor 16 includes a database 40 for storing information relating to a plurality of supply items, such as supply item 26. For example, database 40 can store a plurality of serial numbers and a corresponding plurality of keys, wherein each serial number and its associated key may correspond to a particular one of the plurality of supply items.

Also, licensing vendor 16 facilitates consumer access to a new usage license. For example, a usage license is associated with at least one of imaging device 12 and supply item 26, and when the usage of imaging device 12 and/or supply item 26 has reached a predefined usage threshold, the consumer can be prompted to acquire a new license from licensing vendor 16. This predefined usage threshold can, for example, represent a usage amount that is associated with the license being close to expiring, or a usage amount associated with license expiration. In a preferred method of the invention, licensing vendor 16 has an e-commerce website which can be accessed by a consumer via on-line communications over the Internet to acquire a license renewal or a new license.

Communications link 20 may be established by a direct cable or wireless, e.g., optical or r.f., connection, or by a network connection such as for example an Ethernet local area network (LAN). Communications links 30 and 32 may be established by using standard electrical cabling or bus structures, or by wireless connection.

Communications link 22 is preferably established by an Internet connection (e.g., to facilitate an email or e-commerce transaction), or via a wide area network (WAN). Alternatively, however, communications link 22 graphically represents a communication by a consumer who physically visits the premises of licensing vendor 16, or a telephone link to licensing vendor 16.

License monitoring mechanism 18 is a functional unit that may reside in either of imaging device 12 or host 14, or may reside in a combination of imaging device 12 and a host 14, these options being depicted by the dashed line representing license monitoring mechanism 18. In a preferred embodiment, license monitoring mechanism 18 is resident in the combination of controller 28 of imaging device 12 and imaging driver 38 of host 14. In general, license monitoring mechanism 18 tracks an amount of usage of supply item 26 by imaging device 12, determines whether the amount of usage of supply item 26 by imaging device 12 has reached a usage threshold, and upon reaching the usage threshold, then, for example, prompting the consumer to acquire a new license. Where a consumer desires an on-line e-commerce acquisition of the new license, license monitoring mechanism 18 initiates and establishes communications with licensing vendor 16 for acquiring the new usage license.

The usage license may be structured to require a combination of a particular imaging device, such as imaging device 12, and a particular supply item, such as supply item 26. Such a combination can be verified by the serial number associated with the imaging device and/or the serial number and key associated with a supply item. Alternatively, the license may be structured such that the license only applies to a particular imaging device or to a particular supply item.

Figure 2:
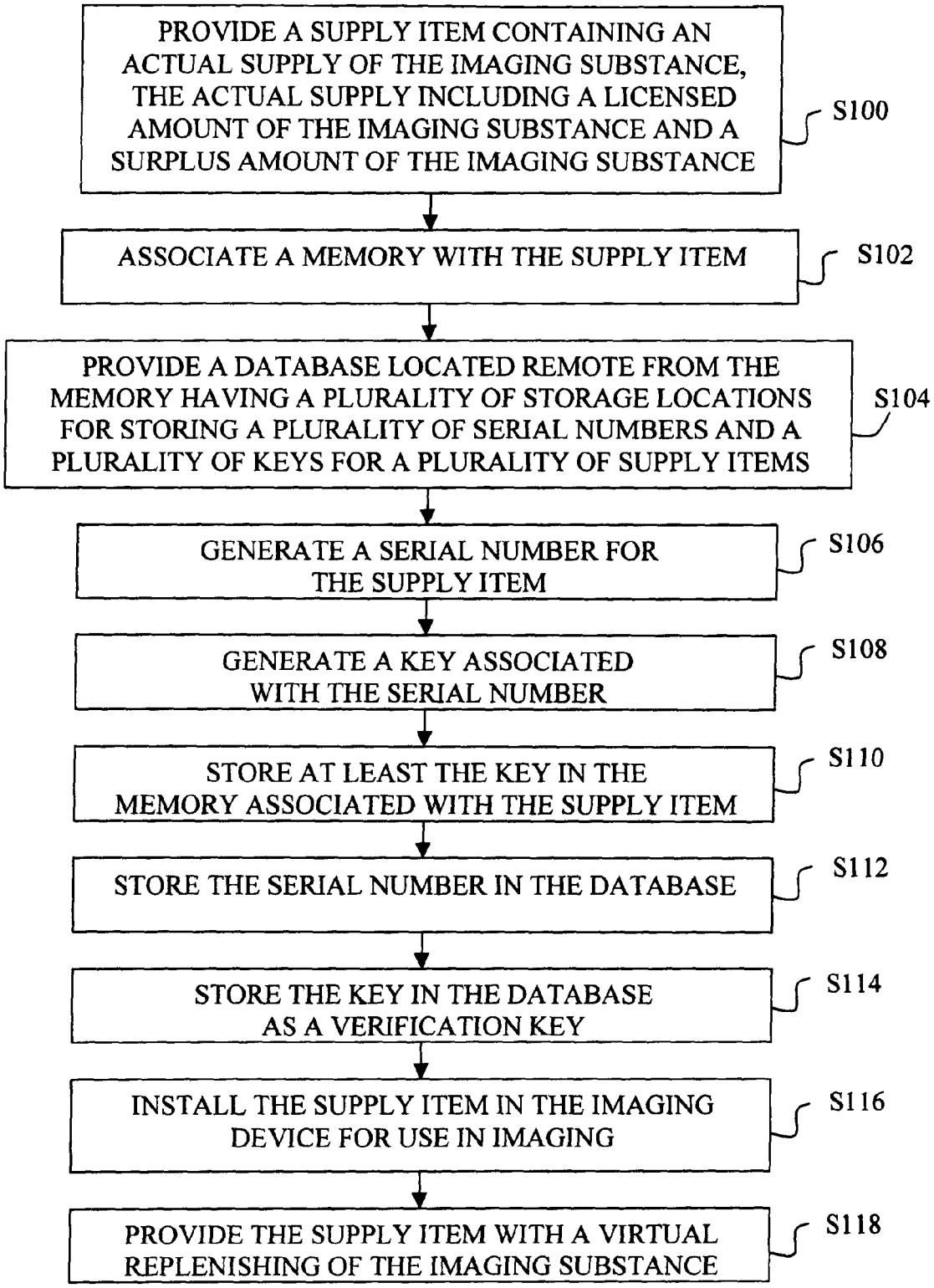
FIG. 2 is a general flowchart of one method for providing imaging substance for use in an imaging device in accordance with the present invention.

FIG. 2 is a general flowchart of one method for providing imaging substance for use in imaging device 12 in accordance with the present invention, which will be described in conjunction with FIG. 1. For example, supply item 26 may undergo a virtual replenishment of imaging substance upon the acquisition of a new license or a license renewal, or after a predetermined amount of imaging substance has been consumed.

At step S100, supply item 26 is provided, e.g., by an original equipment manufacturer, containing an actual supply of imaging substance. The actual supply of imaging substance includes a licensed amount of the imaging substance and a surplus amount of the imaging substance. The surplus amount of imaging substance is used, for example, to accommodate a new license or license renewals.

At step S102, memory module 33, including memory 33*b*, is provided for association with supply item 26. For example, memory module 33 may be attached to supply item 26 during the assembly of supply item 26 during its manufacture. Alternatively, memory module 33 may reside in imaging device 12, such as for example, in controller 28.

At step S104, database 40, which is located remote from memory 33*b*, is provided having a plurality of storage locations for storing a plurality of serial numbers and a plurality of keys for a plurality of supply items. Each key may be, for example, a plurality of digital bits having a value that is used in verifying a serial number to which the key is associated.

At step S106, a serial number is generated, for example, for supply item 26.

At step S108, a key is generated and is associated with the serial number. Thus, for example, supply item 26 will have both a serial number and an associated key.

At step S110, at least the key generated at step S108 is stored in memory 33*b* associated with supply item 26. If desired, the serial number could also be stored in memory 33*b*. Following the storing of the key and/or serial number in memory 33*b*, a security bit is set in memory module 33 that prevents the memory locations of memory 33*b* that stores the key and/or serial number from being rewritten. Preferably, serial numbers and keys are assigned to the plurality of supply items in a non-sequential order.

At step S112, the serial number generated at step S106 is stored in database 40.

At step S114, the key generated at step S108 is stored in database 40 as a verification key. In other words, the key is stored in database 40 so that at a later time the key can be used to verify the authenticity of a serial number.

At step S116, supply item 26 is installed in imaging device 14 for use in imaging. The imaging process then proceeds until, for example, the licensed amount of imaging substance has fallen below a predetermined threshold, such as when the licensed amount is, or is about to be, depleted.

At step S118, supply item 26 undergoes a virtual replenishing of the imaging substance. The virtual replenishing occurs by making available for use at least a portion of the surplus amount of imaging substance in supply item 26. The details of step S118 are described below with respect to FIG. 3. Step S118 may be invoked, for example, after a license is renewed or after a new license is acquired.

Figure 3:
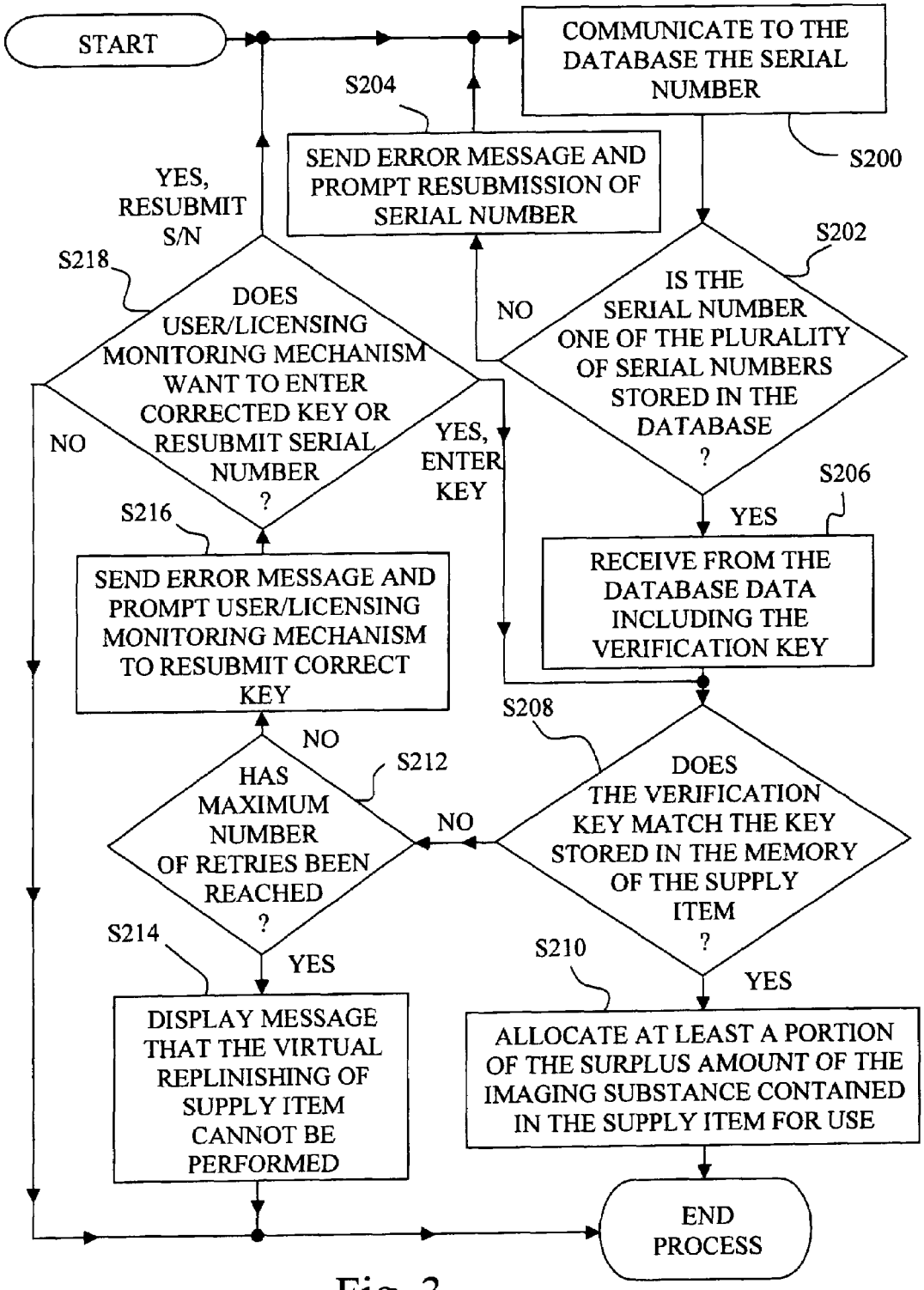
FIG. 3 is a flowchart showing steps of a virtual replenishing process in accordance with the present invention.

FIG. 3 is a flowchart showing steps of the virtual replenishing process of step S118 in accordance with the present invention.

At step S200, the serial number of supply item 26 is communicated to database 40. This communication can occur via the Internet via an e-commerce or email transaction, by telephone, or by a personal visit with licensing vendor 16.

At step S202, it is determined whether the serial number of supply item 26 is one of the plurality of serial numbers stored in database 40 of licensing vendor 16. This occurs by comparing the serial number of supply item 26 with the plurality of serial numbers stored in database 40 until a match is found, or until all possibilities have been exhausted.

If the determination at step S202 is NO, then database 40 provides first data indicating non-correspondence between the serial number communicated to the database 40 at step S200 with one of the plurality of serial numbers stored in database 40, and at step S204 the error is conveyed to the consumer, e.g., by an error message displayed on display 15, and a resubmission of the serial number is prompted, at which time step S200 is repeated.

However, if at step S202 the determination is YES, then the process proceeds to step S206.

At step S206, second data is received from database 40 indicating correspondence between the serial number communicated to the database 40 at step S200 with one of the plurality of serial numbers stored in database 40. The second data includes the verification key that is associated with the serial number communicated to database 40 at step S200.

For example, in an embodiment utilizing Internet communication, database 40 sends the second data, including the verification key, to host 14, which in turn supplies the verification key to imaging device 12. Imaging device 12 may then supply the verification key to memory module 33.

At step S208, it is determined whether the verification key matches the key stored in memory 33*b* associated with supply item 26. This determination may be performed by comparing the verification key received from database 40 with the key stored in memory 33*b* associated with supply item 26. Such a comparison may be performed, for example, by memory module 33.

If the determination at step S208 is YES, then it has been determined that the verification key received from database 40 corresponds to the key stored in memory module associated with of supply item 26. The process then proceeds to step S210.

At step S210, at least a portion of the surplus amount of the imaging substance contained in supply item 26 is allocated for use. This allocation may be in the form of a completion of a license renewal thereby making available for use a predetermined amount of the surplus amount of imaging substance in supply item 26, and thereby completing a virtual replenishing of supply item 26. Following step S210, the process ends.

If the determination at step S208 is NO, then the process proceeds to step S212. A determination at step S208 of NO indicates that it has been determined that the verification key received from database 40 does not correspond to the key stored in memory module 33 associated with supply item 26.

At step S212, it is determined whether the maximum number of retries for entering the correct key has been reached. The number of retries may be tracked, for example, by setting of one or more retry bits in memory module 33. A predetermined number of retries may be arbitrarily selected as the maximum number. The number of retries may be predetermined to be any number of retries, e.g., one, two, or more.

If at step S212 the determination is YES, then at step S214 a message is conveyed to the consumer, e.g., by a message displayed on display 15, indicating that the virtual replenishing of supply item 26 cannot be performed, and the process is ended.

If at step S212 the determination is NO, then the process proceeds to step S216.

At step S216, the error is conveyed to the consumer, e.g., a user. For example, an error message is displayed on display 15, and the user and/or license monitoring mechanism 18 is prompted to resubmit the correct key. The process proceeds to step S218.

At step S218, it is determined whether the user and/or license monitoring mechanism 18 want to resubmit the corrected key or resubmit the serial number. For example, in a manual process the user may not have entered the serial number correctly in communicating with database 40, may have misunderstood or mis-transcribed the key upon receipt of the key from database 40, or may have inadvertently entered the wrong key. As a further example, noise on the communication link, such as communications link 22, may have corrupted either or both of the serial number provided to database 40 or the key returned from database 40. Accordingly, at step S218 the user and/or license monitoring mechanism 18 is provided an opportunity to correct the error.

If at step S218 the determination is NO, then the user and/or license monitoring mechanism 18 does not want to resubmit the correct key or resubmit the serial number, and the process ends.

If at step S218 it is determined that the user and/or license monitoring mechanism 18 want to enter a verification key, e.g., reenter a previously entered key or submit a new key, then the process returns to step S208, wherein it is determined whether the reentered or new verification key matches the key stored in memory 33*b* of supply item 26.

If at step S218 it is determined that the user and/or license monitoring mechanism 18 want to resubmit the serial number, then the process returns to step S200.

In further embodiments of the invention, alternatively, at steps S206 and S208, imaging device 12 may perform the comparison, wherein controller 28 extracts the key stored in memory 33*b* of memory module 33, and then compares the verification key to the extracted key.

As another alternative, at steps S206 and S208, both memory module 33 and imaging device 12 may perform a part of the comparison, wherein controller 28 sends a first portion of the verification key to memory module 33 for comparison to a corresponding portion of the key stored in memory 33*b* of memory module 33, and upon verification of the first portion, a remaining portion of the key stored in memory 33*b* is supplied by memory module 33 to controller 28 for comparison to the corresponding portion of the verification key.

In any event, if the entire verification key matches the entire key stored in memory module 33, then the process proceeds to step S210 for allocation of at least a portion of the surplus amount of the imaging substance contained in supply item 26.

Figure 4:
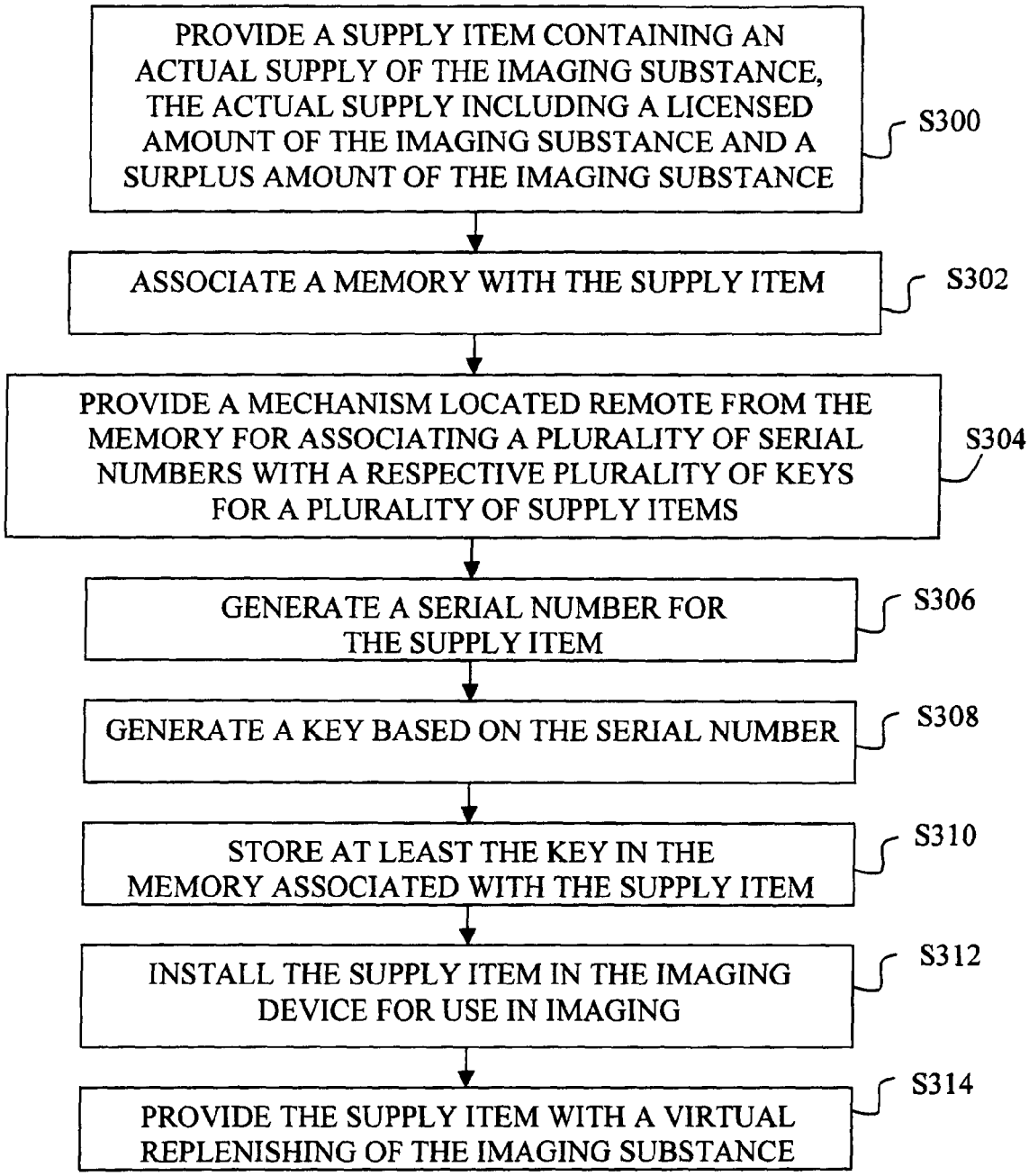
FIG. 4 is a general flowchart of another method for providing imaging substance for use in an imaging device in accordance with the present invention.

FIG. 4 is a general flowchart of another method for providing imaging substance for use in imaging device 12 in accordance with the present invention, which will be described in conjunction with FIG. 1. As before, supply item 26 may undergo a virtual replenishment of imaging substance upon the acquisition of a new license or a license renewal, or after a predetermined amount of imaging substance has been consumed.

At step S300, supply item 26 is provided, e.g., by an original equipment manufacturer, containing an actual supply of imaging substance. The actual supply of imaging substance includes a licensed amount of the imaging substance and a surplus amount of the imaging substance. The surplus amount of imaging substance is used, for example, to accommodate a new license or license renewals.

At step S302, memory module 33, including memory 33*b*, is provided for association with supply item 26. For example, memory module 33 may be attached to supply item 26 during the assembly of supply item 26 during its manufacture. Alternatively, memory module 33 may reside in imaging device 12, such as for example, in controller 28.

At step S304, a mechanism, such as for example licensing vendor 16 and/or database 40, which is located remote from memory 33*b*, is provided for associating a plurality of serial numbers with a respective plurality of keys for a plurality of supply items. Such an association may be as a result of the mechanism calculating, or otherwise deriving, a specific key for association with a specific serial number. Each key may be, for example, a plurality of digital bits having a value that is used in verifying a serial number to which the key is associated.

At step S306, a serial number is generated, for example, for supply item 26.

At step S308, a key is generated based on the serial number. Thus, for example, the mechanism, e.g., licensing vendor 16 and/or database 40, may execute an algorithm, such as an HMAC algorithm, to generate the key as a function of the serial number and a secret, also sometimes referred to as a secret key.

At step S310, at least the key generated at step S308 is stored in memory 33*b* associated with supply item 26. If desired, the serial number could also be stored in memory 33*b*. Following the storing of the key and/or serial number in memory 33*b*, a security bit is set in memory module 33 that prevents the memory locations of memory 33*b* that stores the key and/or serial number from being rewritten. Preferably, serial numbers and keys are assigned to the plurality of supply items in a non-sequential order.

At step S312, supply item 26 is installed in imaging device 14 for use in imaging. The imaging process then proceeds until, for example, the licensed amount of imaging substance has fallen below a predetermined threshold, such as when the licensed amount is, or is about to be, depleted.

At step S314, supply item 26 undergoes a virtual replenishing of the imaging substance. The virtual replenishing occurs by making available for use at least a portion of the surplus amount of imaging substance in supply item 26. The details of step S314 are described below with respect to FIG. 5. Step S314 may be invoked, for example, after a license is renewed or after a new license is acquired.

Figure 5:
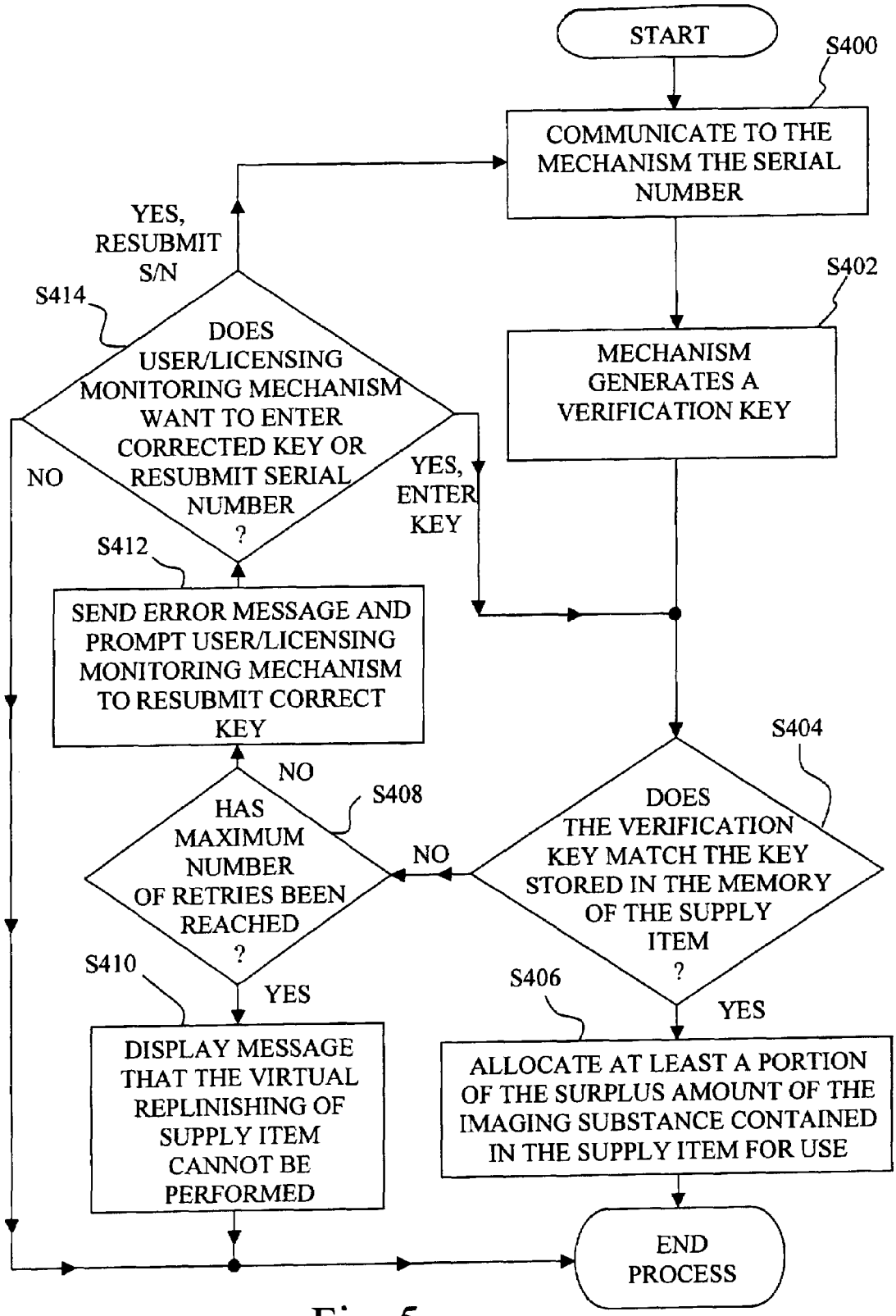
FIG. 5 is a flowchart showing steps of another virtual replenishing process in accordance with the present invention.

FIG. 5 is a flowchart showing steps of the virtual replenishing process of step S314 in accordance with the present invention.

At step S400, the serial number of supply item 26 is communicated to the mechanism, such as for example licensing vendor 16 and/or database 40. This communication can occur via the Internet via an e-commerce or email transaction, by telephone, or by a personal visit with licensing vendor 16.

At step S402, the mechanism, e.g., licensing vendor 16 and/or database 40, generates a verification key. Like the key generated at step S308, discussed above, the verification key is generated based on the serial number. Thus, for example, the mechanism, e.g., licensing vendor 16 and/or database 40, may execute the algorithm used at step S308, such as an HMAC algorithm, to generate the verification key as a function of the serial number and the secret.

At step S404, it is determined whether the verification key matches the key stored in memory 33*b* associated with supply item 26. This determination may be performed by comparing the verification key received from the mechanism, e.g., licensing vendor 16 and/or database 40, with the key stored in memory 33*b* associated with supply item 26. Such a comparison may be performed, for example, by memory module 33.

If the determination at step S404 is YES, then it has been determined that the received verification key corresponds to the key stored in memory module 33 associated with supply item 26. The process then proceeds to step S406.

At step S406, at least a portion of the surplus amount of the imaging substance contained in supply item 26 is allocated for use. This allocation may be in the form of a completion of a license renewal thereby making available for use a predetermined amount of the surplus amount of imaging substance in supply item 26, and thereby completing a virtual replenishing of supply item 26. Following step S406, the process ends.

If the determination at step S404 is NO, then the process proceeds to step S408. A determination at step S404 of NO indicates that it has been determined that the received verification key does not correspond to the key stored in memory module 33 associated with supply item 26.

At step S408, it is determined whether the maximum number of retries for entering the correct key has been reached. The number of retries may be tracked, for example, by setting of one or more retry bits in memory module 33. A predetermined number of retries may be arbitrarily selected as the maximum number. The number of retries may be predetermined to be any number of retries, e.g., one, two, or more.

If at step S408 the determination is YES, then at step S410 a message is conveyed to the consumer, e.g., by a message displayed on display 15, indicating that the virtual replenishing of supply item 26 cannot be performed, and the process is ended.

If at step S408 the determination is NO, then the process proceeds to step S412.

At step S412, the error is conveyed to the consumer, e.g., a user. For example, an error message is displayed on display 15, and the user and/or license monitoring mechanism 18 is prompted to resubmit the correct key. The process proceeds to step S414.

At step S414, it is determined whether the user and/or license monitoring mechanism 18 want to resubmit the corrected key or resubmit the serial number. For example, in a manual process the user may not have entered the serial number correctly in communicating with the mechanism, e.g., licensing vendor 16 and/or database 40, may have misunderstood or mis-transcribed the key upon receipt of the key from the mechanism, or may have inadvertently entered the wrong key. As a further example, noise on the communication link, such as communications link 22, may have corrupted either or both of the serial number provided to the mechanism or the key returned from the mechanism. Accordingly, at step S414 the user and/or license monitoring mechanism 18 is provided an opportunity to correct the error.

If at step S414 the determination is NO, then the user and/or license monitoring mechanism 18 does not want to resubmit the correct key or resubmit the serial number, and the process ends.

If at step S414 it is determined that the user and/or license monitoring mechanism 18 want to enter a verification key, e.g., reenter a previously entered key or submit a new key, then the process returns to step S404, wherein it is determined whether the reentered or new verification key matches the key stored in memory 33*b* of supply item 26.

If at step S414 it is determined that the user and/or license monitoring mechanism 18 want to resubmit the serial number, then the process returns to step S400.

In further embodiments of the invention, alternatively, at step S404, imaging device 12 may perform the comparison, wherein controller 28 extracts the key stored in memory 33*b* of memory module 33, and then compares the verification key to the extracted key.

As another alternative, at step S404, both memory module 33 and imaging device 12 may perform a part of the comparison, wherein controller 28 sends a first portion of the verification key to memory module 33 for comparison to a corresponding portion of the key stored in memory 33*b* of memory module 33, and upon verification of the first portion, a remaining portion of the key stored in memory 33*b* is supplied by memory module 33 to controller 28 for comparison to the corresponding portion of the verification key.

In any event, if the entire verification key matches the entire key stored in memory module 33, then the process proceeds to step S406 for allocation of at least a portion of the surplus amount of the imaging substance contained in supply item 26.

Those skilled in the art will recognize that the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for providing a virtual replenishing of a supply item with an imaging substance, comprising the steps of:

providing a first supply item containing an actual supply of said imaging substance, said actual supply including a licensed amount of said imaging substance and a surplus amount of said imaging substance;

communicating to a database a first serial number associated with said first supply item;

comparing said first serial number with a plurality of serial numbers stored in said database;

receiving from said database one of a first data indicating non-correspondence between said first serial number with one of said plurality of serial numbers and a second data indicating correspondence between said first serial number with one of said plurality of serial numbers, wherein said second data includes a verification key; and comparing said verification key received from said database with a first key stored in a memory associated with said first supply item, wherein if said verification key received from said database corresponds to said first key stored in said memory associated with said first supply item, then performing the step of allocating at least a portion of said surplus amount of said imaging substance contained in said first supply item for use.

2. The method of claim 1, wherein said method is performed when said licensed amount of said imaging substance has fallen below a predetermined threshold.

3. The method of claim 1, wherein the step of comparing said verification key received from said database with said first key stored in said memory associated with said first supply item is performed by a module attached to said supply item.

4. The method of claim 1, wherein the step of comparing said verification key received from said database with said first key stored in said memory associated with said first supply item is performed by a controller of an imaging device.

5. The method of claim 1, wherein the step of comparing said verification key received from said database with said first key stored in said memory associated with said first supply item is performed by the steps of:

sending from a controller of an imaging device a first portion of said verification key to a module attached to said first supply item;

said module comparing said first portion of said verification key to a corresponding portion of said first key stored in said memory associated with said first supply item, and upon verification of said first portion, said module supplying to said controller a remaining portion of said first key stored in said memory for comparison by said controller to a corresponding portion of said verification key.

6. The method of claim 1, wherein if said verification key received from said database does not correspond to said first key stored in said memory associated with said first supply item, then performing the step of prompting at least one of a user and a monitoring mechanism to resubmit said first serial number.

7. The method of claim 6, wherein if there is no correspondence between said verification key and said first key in a predetermined number of attempts, then performing the step of displaying a message indicating that said virtual replenishing of said supply item with said imaging substance cannot be performed.

8. The method of claim 1, wherein if said verification key received from said database does not correspond to said first key stored in said memory associated with said first supply item, then performing the step of prompting at least one of a user and a monitoring mechanism to enter a corrected key.

9. The method of claim 8, wherein if there is no correspondence between said verification key and said first key in a predetermined number of attempts, then performing the step of displaying a message indicating that said virtual replenishing of said supply item with said imaging substance cannot be performed.

10. The method of claim 1, wherein the step of comparing said verification key is repeated a predetermined number of times.

11. The method of claim 10, wherein if there is no correspondence between said verification key and said first key in said predetermined number of times, then performing the step of displaying a message indicating that said virtual replenishing of said supply item with said imaging substance cannot be performed.

12. The method of claim 1, wherein said memory is attached to said supply item.

13. A method for providing a virtual replenishing of a supply item with an imaging substance, comprising the steps of:

providing a first supply item containing an actual supply of said imaging substance, said actual supply including a licensed amount of said imaging substance and a surplus amount of said imaging substance;

communicating to a mechanism a first serial number associated with said first supply item;

generating a verification key based on said first serial number;

comparing said verification key received from said mechanism with a first key stored in a memory associated with said first supply item, wherein if said verification key received from said mechanism corresponds to said first key stored in said memory associated with said first supply item, then performing the step of allocating at least a portion of said surplus amount of said imaging substance contained in said first supply item for use.

14. The method of claim 13, wherein said method is performed when said licensed amount of said imaging substance has fallen below a predetermined threshold.

15. The method of claim 13, wherein the step of comparing said verification key received from said mechanism with said first key stored in said memory associated with said first supply item is performed by a module attached to said supply item.

16. The method of claim 13, wherein the step of comparing said verification key received from said mechanism with said first key stored in said memory associated with said first supply item is performed by a controller of an imaging device.

17. The method of claim 13, wherein the step of comparing said verification key received from said mechanism with said first key stored in said memory associated with said first supply item is performed by the steps of:

sending from a controller of an imaging device a first portion of said verification key to a module attached to said first supply item;

said module comparing said first portion of said verification key to a corresponding portion of said first key stored in said memory associated with said first supply item, and upon verification of said first portion, said module supplying to said controller a remaining portion of said first key stored in said memory for comparison by said controller to a corresponding portion of said verification key.

18. The method of claim 13, wherein if said verification, key received from said mechanism does not correspond to said first key stored in said memory associated with said first supply item, then performing the step of prompting at least one of a user and a monitoring mechanism to resubmit said first serial number.

19. The method of claim 18, wherein if there is no correspondence between said verification key and said first key in a predetermined number of attempts, then performing the step of displaying a message indicating that said virtual replenishing of said supply item with said imaging substance cannot be performed.

20. The method of claim 13, wherein if said verification key received from said mechanism does not correspond to said first key stored in said memory associated with said first supply item, then performing the step of prompting at least one of a user and a monitoring mechanism to enter a corrected key.

21. The method of claim 20, wherein if there is no correspondence between said verification key and said first key in a predetermined number of attempts, then performing the step of displaying a message indicating that said virtual replenishing of said supply item with said imaging substance cannot be performed.

22. The method of claim 13, wherein the step of comparing said verification key is repeated a predetermined number of times.

23. The method of claim 22, wherein if there is no correspondence between said verification key and said first key in said predetermined number of times, then performing the step of displaying a message indicating that said virtual replenishing of said supply item with said imaging substance cannot be performed.

24. The method of claim 13, wherein said memory is attached to said supply item.

25. The method of claim 13, wherein said first key is generated based on said first serial number by said mechanism executing an algorithm.

26. The method of claim 25, wherein said algorithm is an HMAC algorithm.

27. The method of claim 13, wherein the step of generating said verification key based on said first serial number is performed by said mechanism executing an algorithm.

28. The method of claim 27, wherein said algorithm is an HMAC algorithm.

29. A method for providing imaging substance for use in an imaging device, comprising the steps:

providing a first supply item containing an actual supply of said imaging substance, said actual supply including a licensed amount of said imaging substance and a surplus amount of said imaging substance;

associating a memory with said first supply item;

providing a database located remote from said memory for storing a plurality of serial numbers and a plurality of keys for a plurality of supply items;

generating a first serial number for said first supply item;

generating a first key associated with said first serial number;

storing at least said first key in said memory associated with said first supply item;

storing said first serial number in said database;

storing said first key in said database as a verification key;

installing said first supply item in said imaging device for use in imaging; and providing a virtual replenishing of said supply item with said imaging substance by the steps of:

communicating to said database said first serial number;

comparing said first serial number with said plurality of serial numbers stored in said database;

receiving from said database one of a first data indicating non-correspondence between said first serial number with one of said plurality of serial numbers and a second data indicating correspondence between said first serial number with one of said plurality of serial numbers, wherein said second data includes said verification key; and comparing said verification key received from said database with said first key stored in said memory of said first supply item, wherein if said verification key received from said database corresponds to said first key stored in said memory associated with said first supply item, then performing the step of allocating at least a portion of said surplus amount of said imaging substance contained in said first supply item for use.

30. A method for providing imaging substance for use in an imaging device, comprising the steps:

providing a first supply item containing an actual supply of said imaging substance, said actual supply including a licensed amount of said imaging substance and a surplus amount of said imaging substance;

providing a memory that is associated with said first supply item;

providing a mechanism located remote from said memory for associating a plurality of serial numbers with a respective plurality of keys for a plurality of supply items;

generating a first serial number for said first supply item;

generating a first key based on said first serial number;

storing at least said first key in said memory associated with said first supply item;

installing said first supply item in said imaging device for use in imaging; and providing a virtual replenishing of said supply item with said imaging substance by the steps of:

communicating to said mechanism said first serial number;

generating a verification key based on said first serial number;

comparing said verification key received from said mechanism with said first key stored in said memory of said first supply item, wherein if said verification key received from said mechanism corresponds to said first key stored in said memory associated with said first supply item, then performing the step of allocating at least a portion of said surplus amount of said imaging substance contained in said first supply item for use.

31. A method for providing a virtual replenishing of a supply item with an imaging substance, said supply item containing an actual supply of said imaging substance, said actual supply including a licensed amount of said imaging substance and a surplus amount of said imaging substance, comprising:

communicating to a database a first serial number associated with said supply item, wherein said first serial number is compared with a plurality of serial numbers stored in said database;

receiving from said database one of a first data indicating non-correspondence between said first serial number with one of said plurality of serial numbers and a second data indicating correspondence between said first serial number with one of said plurality of serial numbers, wherein said second data includes a verification key; and comparing said verification key received from said database with a first key stored in a memory associated with said supply item, wherein if said verification key received from said database corresponds to said first key stored in said memory associated with said supply item, then allocating at least a portion of said surplus amount of said imaging substance contained in said supply item for use.

32. The method of claim 31, wherein said method is performed when said licensed amount of said imaging substance has fallen below a predetermined threshold.

33. The method of claim 31, wherein the act of comparing said verification key received from said database with said first key stored in said memory associated with said supply item is performed by a module attached to said supply item.

34. The method of claim 31, wherein the act of comparing said verification key received from said database with said first key stored in said memory associated with said supply item is performed by a controller of an imaging device.

35. The method of claim 31, wherein the act of comparing said verification key received from said database with said first key stored in said memory associated with said supply item is performed by:

sending from a controller of an imaging device a first portion of said verification key to a module attached to said supply item;

said module comparing said first portion of said verification key to a corresponding portion of said first key stored in said memory associated with said supply item, and upon verification of said first portion, said module supplying to said controller a remaining portion of said first key stored in said memory for comparison by said controller to a corresponding portion of said verification key.

36. The method of claim 31, wherein if said verification key received from said database does not correspond to said first key stored in said memory associated with said supply item, then prompting at least one of a user and a monitoring mechanism to resubmit said first serial number.

37. The method of claim 36, wherein if there is no correspondence between said verification key and said first key in a predetermined number of attempts, then displaying a message indicating that said virtual replenishing of said supply item with said imaging substance cannot be performed.

38. The method of claim 31, wherein if said verification key received from said database does not correspond to said first key stored in said memory associated with said supply item, then prompting at least one of a user and a monitoring mechanism to enter a corrected key.

39. The method of claim 38, wherein if there is no correspondence between said verification key and said first key in a predetermined number of attempts, then displaying a message indicating that said virtual replenishing of said supply item with said imaging substance cannot be performed.

40. The method of claim 31, wherein the act of comparing said verification key is repeated a predetermined number of times.

41. The method of claim 40, wherein if there is no correspondence between said verification key and said first key in said predetermined number of times, then displaying a message indicating that said virtual replenishing of said supply item with said imaging substance cannot be performed.

42. The method of claim 31, wherein said memory is attached to said supply item.

43. A method for providing a virtual replenishing of a supply item with an imaging substance, wherein said supply item contains an actual supply of the imaging substance, said actual supply including a licensed amount of said imaging substance and a surplus amount of said imaging substance, comprising:

communicating to a mechanism a serial number associated with said supply item;

receiving a verification key based on said serial number;

comparing said verification key received from said mechanism with a key stored in a memory associated with said supply item, wherein if said verification key received from said mechanism corresponds to said key stored in said memory associated with said supply item, at least a portion of said surplus amount of said imaging substance contained in said supply item is allocated for use.

44. The method of claim 43, wherein said method is performed when said licensed amount of said imaging substance has fallen below a predetermined threshold.

45. The method of claim 43, wherein the act of comparing said verification key received from said mechanism with said key stored in said memory associated with said supply item is performed by a module attached to said supply item, wherein the module also comprises the memory.

46. The method of claim 43, wherein the act of comparing said verification key received from said mechanism with said key stored in said memory associated with said supply item is performed by a controller of an imaging device.

47. The method of claim 43, wherein the act of comparing said verification key received from said mechanism with said key stored in said memory associated with said supply item is performed by:

sending from a controller of an imaging device a first portion of said verification key to a module attached to said supply item;

said module comparing said first portion of said verification key to a corresponding portion of said key stored in said memory associated with said supply item, and upon verification of said first portion, said module supplying to said controller a remaining portion of said key stored in said memory for comparison by said controller to a corresponding portion of said verification key.

48. The method of claim 43, wherein if said verification key received from said mechanism does not correspond to said key stored in said memory associated with said supply item, then prompting at least one of a user and a monitoring mechanism to resubmit said serial number.

49. The method of claim 48, wherein if there is no correspondence between said verification key and said key in a predetermined number of attempts, then displaying a message indicating that said virtual replenishing of said supply item with said imaging substance cannot be performed.

50. The method of claim 43, wherein if said verification key received from said mechanism does not correspond to said key stored in said memory associated with said supply item, then prompting at least one of a user and a monitoring mechanism to enter a corrected key.

51. The method of claim 50, wherein if there is no correspondence between said verification key and said key in a predetermined number of attempts, then displaying a message indicating that said virtual replenishing of said supply item with said imaging substance cannot be performed.

52. The method of claim 43, wherein the act of comparing said verification key is repeated a predetermined number of times.

53. The method of claim 52, wherein if there is no correspondence between said verification key and said key in said predetermined number of times, then displaying a message indicating that said virtual replenishing of said supply item with said imaging substance cannot be performed.

54. The method of claim 43, wherein said memory is attached to said supply item.

55. The method of claim 43, wherein said key stored in said memory is generated based on said serial number by executing an algorithm.

56. The method of claim 55, wherein said algorithm is an HMAC algorithm.

57. The method of claim 43, wherein the act of generating said verification key based on said serial number is performed by said mechanism executing an algorithm.

58. The method of claim 57, wherein said algorithm is an HMAC algorithm.

59. A method for providing a virtual replenishing of a supply item with an actual supply of imaging substance, wherein said supply item includes a licensed amount of said imaging substance and a surplus amount of said imaging substance, and wherein a serial number associated with said supply item can be communicated to a mechanism for generating a verification key based on the serial number, comprising:

supplying said verification key for comparison with a key stored in a memory associated with said supply item, wherein if said verification key supplied for comparison corresponds to said key, at least a portion of the surplus amount contained in said supply item is allocated for use.

60. The method of claim 59, wherein said method is performed when said licensed amount of said imaging substance has fallen below a predetermined threshold.

61. The method of claim 59, wherein the act of comparing said verification key with said key stored in said memory associated with said supply item is performed by a module attached to said supply item, wherein the module also comprises the memory.

62. The method of claim 59, wherein the act of comparing said verification key with said key stored in said memory associated with said supply item is performed by a controller of an imaging device.

63. The method of claim 59, wherein the act of comparing said verification key with said key stored in said memory associated with said supply item is performed by:

sending from a controller of an imaging device a first portion of said verification key to a module attached to said supply item;

said module comparing said first portion of said verification key to a corresponding portion of said key stored in said memory associated with said supply item, and upon verification of said first portion, said module supplying to said controller a remaining portion of said key stored in said memory for comparison by said controller to a corresponding portion of said verification key.

64. The method of claim 59, wherein if said verification key does not correspond to said key stored in said memory associated with said supply item, then prompting at least one of a user and a monitoring mechanism to resubmit said serial number.

65. The method of claim 64, wherein if there is no correspondence between said verification key and said key in a predetermined number of attempts, then displaying a message indicating that said virtual replenishing of said supply item with said imaging substance cannot be performed.

66. The method of claim 59, wherein if said verification key does not correspond to said key stored in said memory associated with said supply item, then prompting at least one of a user and a monitoring mechanism to enter a corrected key.

67. The method of claim 66, wherein if there is no correspondence between said verification key and said key in a predetermined number of attempts, then displaying a message indicating that said virtual replenishing of said supply item with said imaging substance cannot be performed.

68. The method of claim 59, wherein the act of comparing said verification key is repeated a predetermined number of times.

69. The method of claim 68, wherein if there is no correspondence between said verification key and said key in said predetermined number of times, then displaying a message indicating that said virtual replenishing of said supply item with said imaging substance cannot be performed.

70. The method of claim 59, wherein said memory is attached to said supply item.

71. The method of claim 59, wherein said key stored in said memory is generated based on said serial number by executing an algorithm.

72. The method of claim 71, wherein said algorithm is an HMAC algorithm.

73. The method of claim 59, wherein the act of generating said verification key based on said serial number is performed by said mechanism executing an algorithm.

74. The method of claim 73, wherein said algorithm is an HMAC algorithm.

75. A method for providing a virtual replenishing of a supply item with an imaging substance, wherein said supply item contains an actual supply of the imaging substance, said actual supply including a licensed amount of said imaging substance and a surplus amount of said imaging substance, comprising:

receiving a serial number associated with said supply item; and generating a verification key based on said serial number, wherein said verification key is compared with a key stored in a memory associated with said supply item, and if said verification key corresponds to said key stored in said memory associated with said supply item, at least a portion of said surplus amount of said imaging substance contained in said supply item is allocated for use.

76. The method of claim 75, wherein said method is performed when said licensed amount of said imaging substance has fallen below a predetermined threshold.

77. The method of claim 75, wherein the act of comparing said verification key with said key stored in said memory associated with said supply item is performed by a module attached to said supply item, wherein the module also comprises the memory.

78. The method of claim 75, wherein the act of comparing said verification key with said key stored in said memory associated with said supply item is performed by a controller of an imaging device.

79. The method of claim 75, wherein the act of comparing said verification key with said key stored in said memory associated with said supply item is performed by:

sending from a controller of an imaging device a first portion of said verification key to a module attached to said supply item;

said module comparing said first portion of said verification key to a corresponding portion of said key stored in said memory associated with said supply item, and upon verification of said first portion, said module supplying to said controller a remaining portion of said key stored in said memory for comparison by said controller to a corresponding portion of said verification key.

80. The method of claim 75, wherein if said verification key does not correspond to said key stored in said memory associated with said supply item, then prompting at least one of a user and a monitoring mechanism to resubmit said serial number.

81. The method of claim 80, wherein if there is no correspondence between said verification key and said key in a predetermined number of attempts, then displaying a message indicating that said virtual replenishing of said supply item with said imaging substance cannot be performed.

82. The method of claim 75, wherein if said verification key does not correspond to said key stored in said memory associated with said supply item, then prompting at least one of a user and a monitoring mechanism to enter a corrected key.

83. The method of claim 82, wherein if there is no correspondence between said verification key and said key in a predetermined number of attempts, then displaying a message indicating that said virtual replenishing of said supply item with said imaging substance cannot be performed.

84. The method of claim 75, wherein the act of comparing said verification key is repeated a predetermined number of times.

85. The method of claim 84, wherein if there is no correspondence between said verification key and said key in said predetermined number of times, then displaying a message indicating that said virtual replenishing of said supply item with said imaging substance cannot be performed.

86. The method of claim 75, wherein said memory is attached to said supply.

87. The method of claim 75, wherein said key stored in said memory is generated based on said serial number by executing an algorithm.

88. The method of claim 87, wherein said algorithm is an HMAC algorithm.

89. The method of claim 75, wherein the act of generating said verification key based on said serial number is performed by a mechanism executing an algorithm.

90. The method of claim 89, wherein said algorithm is an HMAC algorithm.

* * * * *